US010815839B2

(12) United States Patent
McCarthy, Jr. et al.

(10) Patent No.: US 10,815,839 B2
(45) Date of Patent: Oct. 27, 2020

(54) TWO STEP ROCKER ARM HAVING SIDE BY SIDE ROLLER CONFIGURATION

(71) Applicant: Eaton Intelligent Power Limited, Dublin (IE)

(72) Inventors: James E. McCarthy, Jr., Kalamazoo, MI (US); Dale Arden Stretch, Novi, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/284,454

(22) Filed: Feb. 25, 2019

(65) Prior Publication Data

US 2019/0186304 A1 Jun. 20, 2019

Related U.S. Application Data

(63) Continuation of application No. PCT/US2016/067992, filed on Dec. 21, 2016.

(60) Provisional application No. 62/378,450, filed on Aug. 23, 2016, provisional application No. 62/378,458, filed on Aug. 23, 2016.

(51) Int. Cl.

| | |
|---|---|
| ***F01L 1/34*** | (2006.01) |
| ***F01L 1/18*** | (2006.01) |
| ***F01L 1/26*** | (2006.01) |
| ***F01M 1/16*** | (2006.01) |

(Continued)

(52) U.S. Cl.

CPC ..... *F01L 1/18* (2013.01); *F01L 1/185* (2013.01); *F01L 1/24* (2013.01); *F01L 1/2416* (2013.01); *F01L 1/26* (2013.01); *F01L 1/267* (2013.01); *F01L 13/0036* (2013.01); *F01M 1/16* (2013.01);

(Continued)

(58) Field of Classification Search

CPC ..... F01L 1/2416; F01L 1/185; F01L 1/267; F01L 1/18; F01L 1/24; F01L 1/26; F01L 13/0036; F01L 2001/186; F01L 2001/2433; F01L 2105/00; F01M 1/16

See application file for complete search history.

(56) References Cited

U.S. PATENT DOCUMENTS 5,544,626 A 8/1996 Diggs et al.
6,532,920 B1 * 3/2003 Sweetnam ..... F01L 1/185 123/90.16

FOREIGN PATENT DOCUMENTS

WO 2006090292 A3 11/2006

OTHER PUBLICATIONS

International Search Report and Written Opinion for International Application No. PCT/US2016/067992 dated May 23, 2017, 21 pages.

* cited by examiner

*Primary Examiner* — Zelalem Eshete
(74) *Attorney, Agent, or Firm* — RMCK Law Group PLC

(57) ABSTRACT

A rocker arm assembly constructed in accordance to one example of the present disclosure includes an outer rocker arm, a first inner rocker arm, and a second inner rocker arm. The first inner rocker arm is configured to move between a latched and unlatched position relative to the outer rocker arm. The second inner rocker arm is configured to move between a latched and unlatch position relative to the outer rocker arm. The rocker arm assembly provides at least three distinct lift profiles including (i) a first lift profile when the first inner rocker arm is latched and the second inner rocker (Continued)

arm is unlatched, (ii) a second lift profile when the second inner rocker arm is latched and the first inner rocker arm is unlatched, and (iii) a third lift profile when both the first and second inner rocker arms are unlatched.

23 Claims, 6 Drawing Sheets

(51) Int. Cl.
*F01L 1/24* (2006.01)
*F01L 13/00* (2006.01)

(52) U.S. Cl.
CPC . *F01L 2001/186* (2013.01); *F01L 2001/2433* (2013.01); *F01L 2305/00* (2020.05)

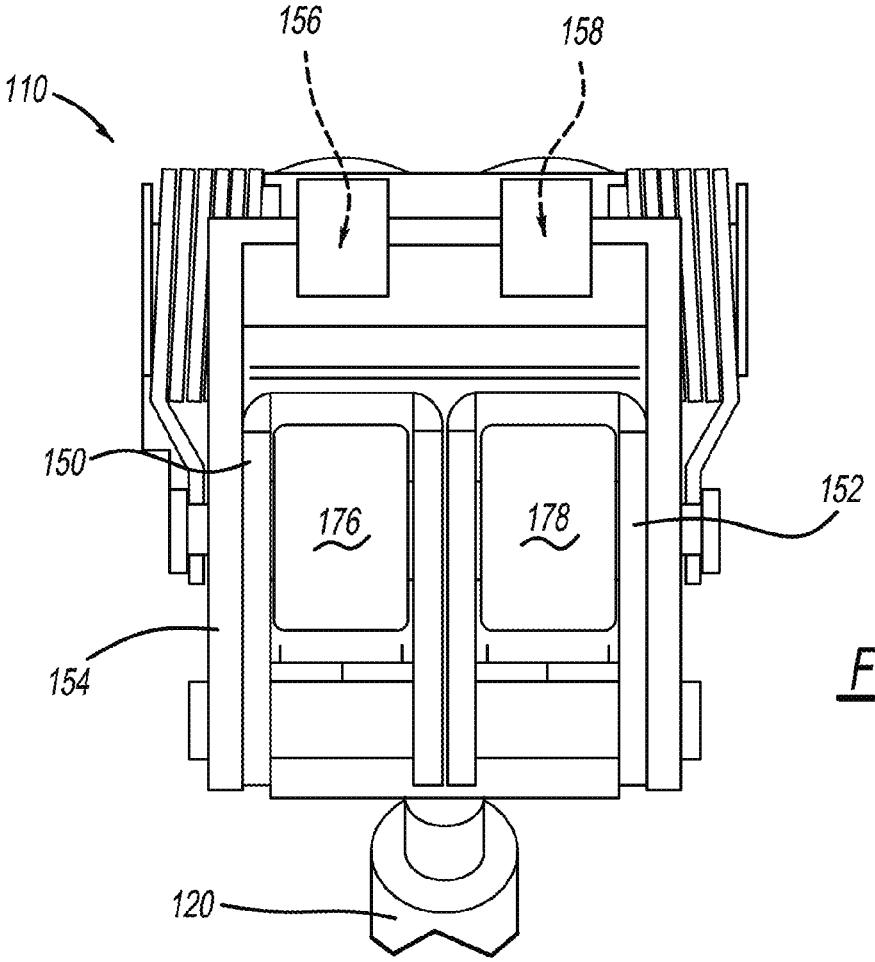
FIG - 2
| | | |
|---|---|---|
| 1 | ( Latched Lift 1 ) | ( Unlatched X ) |
| 2 | ( Unlatched X ) | ( Latched Lift 2 ) |
| 3 | ( Unlatched X ) | ( Unlatched X ) |
| 4 | ( Latched Lift 1 ) | ( Latched Lift 2 ) |
FIG - 2A
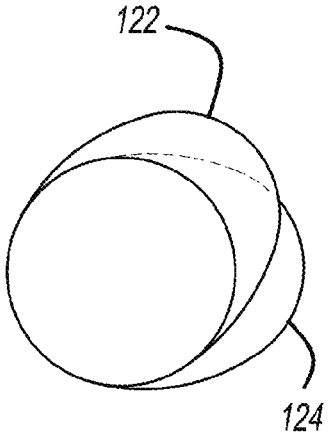
FIG - 2B

TWO STEP ROCKER ARM HAVING SIDE BY SIDE ROLLER CONFIGURATION

CROSS-REFERENCE TO RELATED APPLICATIONS

This application is a continuation of International Application No. PCT/US2016/067992 filed on Dec. 21, 2016, which claims the benefit of U.S. Patent Application No. 62/378,450 filed on Aug. 23, 2016 and U.S. Patent Application No. 62/378,458 filed on Aug. 23, 2016. The disclosures of the above applications are incorporated herein by reference.

FIELD

The present disclosure relates generally to switching valvetrain systems.

BACKGROUND

Combustion cycles on four-stroke internal combustion engines can be modified to achieve various desired results such as improved fuel economy. In one method, the expansion stroke is increased relative to the compression stroke. The effect is sometimes referred to as a Miller Cycle or as an Atkinson Cycle. The Miller and Atkinson Cycles can be achieved by either closing the intake valve earlier than a normal or Otto Cycle ("Base") with a shorter than normal intake valve lift duration ("EIVC"), or by closing the intake valve later by a longer than normal intake valve lift profile ("LIVC").

Various systems have been developed for altering the valve-lift characteristics for internal combustion engines. Such systems, commonly known as variable valve timing (VVT) or variable valve actuation (VVA), improve fuel economy, reduce emissions and improve drive comfort over a range of speeds.

Discrete variable valve lift can be obtained through the use of switching rocker arm technology. Switching rocker arms allow for control of valve actuation by alternating between latched and unlatched states, usually involving an inner arm and an outer arm. In some circumstances, these arms engage different cam lobes, such as low-lift lobes, high-lift lobes, and no-lift lobes. Mechanisms are required for switching rocker arm modes in a manner suited for operation of internal combustion engines.

SUMMARY

A rocker arm assembly constructed in accordance to one example of the present disclosure includes an outer rocker arm, a first inner rocker arm, and a second inner rocker arm. The first inner rocker arm is configured to move between a latched and unlatched position relative to the outer rocker arm. The second inner rocker arm is configured to move between a latched and unlatch position relative to the outer rocker arm. The second inner rocker arm is positioned in a side-by-side relationship relative to the first inner rocker arm. The rocker arm assembly provides at least three distinct lift profiles including (i) a first lift profile when the first inner rocker arm is latched and the second inner rocker arm is unlatched, (ii) a second lift profile when the second inner rocker arm is latched and the first inner rocker arm is unlatched, and (iii) a third lift profile when both the first and second inner rocker arms are unlatched.

According to additional features, the rocker arm assembly further comprises a dual lash adjuster configuration including a first hydraulic lash adjuster (HLA) and a second HLA. The first HLA cooperates with a first oil control valve (OCV) to provide hydraulic fluid to the rocker arm assembly and actuate a first latch associated with the first inner rocker arm to move the first inner rocker arm between the latched and unlatched position. The second HLA cooperates with a second oil control valve (OCV) to provide hydraulic fluid to the rocker arm assembly and actuate a second latch associated with the second inner rocker arm to move the second inner rocker arm between the latched and unlatched position.

According to other features, the rocker arm assembly further comprises a single lash adjuster configuration including a hydraulic lash adjuster (HLA). The HLA cooperates with an oil control valve (OCV) to provide hydraulic fluid to the rocker arm assembly and actuate (i) a first latch associated with the first inner rocker arm to move the first inner rocker arm between the latched and unlatched position, (ii) a second latch associated with the second inner rocker arm to move the second inner rocker arm between the latched and unlatched position. The first inner rocker arm has a first roller and a second inner rocker arm has a second roller. The first roller is configured to engage a first actuating lobe of a cam profile and the second roller is configured to engage a second actuating lobe of the cam profile.

A rocker arm assembly constructed in accordance to additional features includes an outer rocker arm having a first roller. An inner rocker arm is configured to move between a latched and unlatched position relative to the outer rocker arm. The first inner rocker arm has a second roller. The first and second rollers are arranged in a side-by-side relationship.

In other features, the first roller and the second roller are configured for rotation around a common axis. The rocker arm assembly can further include a single lash adjuster configuration including a hydraulic lash adjuster (HLA) The HLA cooperates with an oil control valve (OCV) to provide hydraulic fluid to the rocker arm assembly and actuate a first latch associated with the inner rocker arm to move the first rocker arm between the latched and unlatched position. The rocker arm assembly can provide at least two lift profiles including (i) a first lift profile when the inner rocker arm is latched, and (ii) a second lift profile when the inner rocker arm is unlatched.

A rocker arm assembly constructed in accordance to additional features of the present disclosure includes an outer rocker arm and an inner rocker arm. The outer rocker arm has a first roller configuration that rotates around a first axis. The inner rocker arm has a second roller configuration that rotates around a second axis. The inner rocker arm is configured to move between a latched and unlatched position relative to the outer rocker arm. The inner and outer rocker arms are asymmetric such that the first and second axes are offset. One of the first and second axes is positioned for alignment over an engine valve.

According to additional features, the rocker arm assembly further includes a lash adjuster (HLA) that cooperates with a first oil control valve (OCV) to provide hydraulic fluid to the rocker arm assembly and actuate a first latch associated with the inner rocker arm to move the inner arm between the latched and unlatched position. The first roller configuration of the outer rocker arm comprises a pair of rollers. When the inner rocker arm is latched, a single cam profile rests between the first and second roller configurations. When the single cam profile rotates, the engine valve is opened on one of the first and second roller configurations and closed on the other of the first and second roller configurations. When the inner rocker arm is unlatched, the single cam profile rests on one of the first and second roller configurations. When the single cam profile rotates, the engine valve is opened and closed on the second roller configuration. The inner and outer rocker arms provide asymmetric loading. The second axis is aligned with the engine valve.

A rocker arm assembly constructed in accordance to other features of the present disclosure includes an outer rocker arm and an inner rocker arm. The outer rocker arm has a first roller configuration that rotates around a first axis. The inner rocker arm has a second roller configuration that rotates around a second axis. The inner rocker arm is configured to move between a latched and unlatched position relative to the outer rocker arm. The inner and outer rocker arms are asymmetric such that the first and second axes are offset. Both of the first and second axes are positioned for alignment offset from an engine valve.

According to additional features, the rocker arm assembly further comprises a lash adjuster (HLA) that cooperates with a first oil control valve (OCV) to provide hydraulic fluid to the rocker arm assembly and actuate a first latch associated with the inner rocker arm to move the rocker arm between the latched and unlatched position. The first roller configuration of the outer rocker arm comprises a pair of rollers. The second roller configuration includes a single roller that is offset closer to the engine valve than the first roller configuration.

In other features, when the inner rocker arm is latched, a single cam profile rests between the first and second roller configurations. When the single cam profile rotates, the engine valve is opened on one of the first and second roller configurations and closed on the other of the first and second roller configurations. When the inner rocker arm is unlatched, the single cam profile rests on one of the first and second roller configurations. When the single cam profile rotates, the engine valve is opened and closed on the second roller configuration. The inner and outer rocker arms provide asymmetric loading.

BRIEF DESCRIPTION OF THE DRAWINGS

FIG. 2 is a top view of the second rocker arm assembly of FIG. 1 and illustrating two movable roller rocker arms that are mounted side by side within a single rocker arm assembly and having two latch pins;

FIG. 2A is a table showing latched and unlatched options for the second rocker arm assembly shown in FIG. 2;

FIG. 2B is a side perspective view of an offset cam profile including two cams having different duration and phasing;

DETAILED DESCRIPTION

Figure 1:
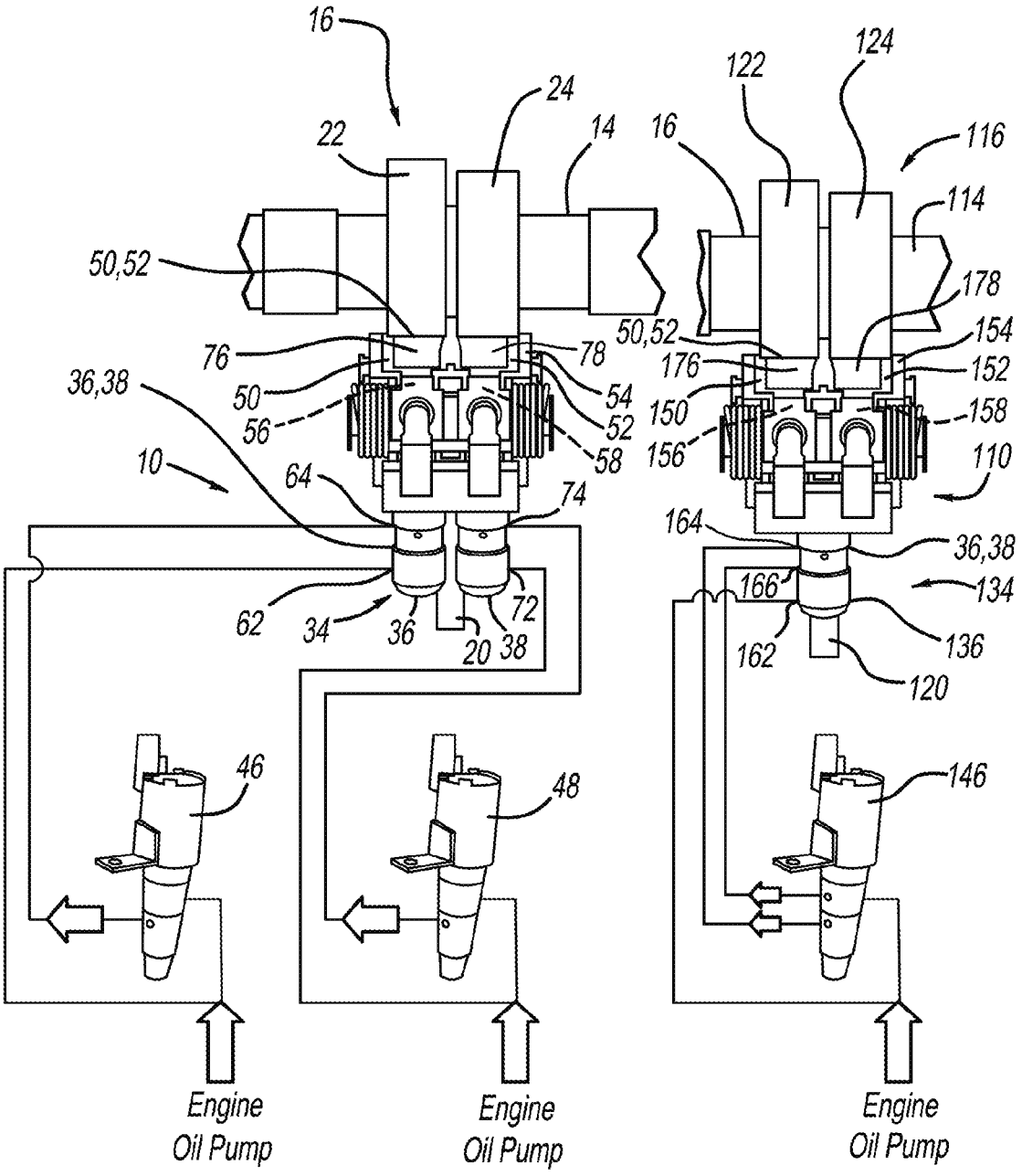
FIG. 1 is a rear view of a first rocker arm assembly configured for use with a dual lash adjuster and a second rocker arm assembly configured for use with a single lash adjuster according to examples of the present disclosure.

With initial reference to FIG. 1, a first rocker arm assembly 10 configured for use with a pair of lash adjusters and constructed in accordance to one example of the present disclosure will be described. The first rocker arm assembly 10 can be configured for use in a Type II arrangement having a cam shaft 14 with a cam profile 16 and located above an engine valve 20 (overhead cam). In the particular example shown, the cam profile 16 includes two valve actuating lobes 22 and 24. In a Type II valve train, the cam profile 16 of the cam shaft 14 drives the rocker arm assembly 10, and the first end of the rocker arm assembly 10 pivots over a hydraulic lash adjuster (HLA) while the second end actuates the valve 20.

In one configuration according to the present teachings, the rocker arm assembly 10 pivots over a dual lash adjuster configuration 34 having a first dual-feed hydraulic lash adjuster (DFHLA) 36 and a second DFHLA 38. As will become appreciated, the first rocker arm assembly 10 is actuated with a combination of the DFHLAs 36 and 38 and associated oil control valves (OCV) 46 and 48. It will further be appreciated that the DFHLA's are exemplary and other HLA's may be substituted within the scope of the present disclosure. It is also appreciated that other hydraulic configurations may be implemented for delivering hydraulic fluid to the DFHLAs 36 and 38. Additionally or alternatively the rocker arm assemblies disclosed herein may be configured for electrical latching. As will become appreciated herein, the present disclosure provides a reduced package two step actuating rocker arm with reduced complexity over prior art configuration. Further, the present teachings can provide a three step option with two lifts and one deactivation option.

The first rocker arm assembly 10 includes a first inner rocker arm 50, a second inner rocker arm 52 and an outer rocker arm 54. The first inner rocker arm 50 cooperates with a first latch 56. The second inner rocker arm 52 cooperates with a second latch 58 (the latch configurations are best shown in the example illustrated in FIGS. 2 and 3). As will be described herein, the first and second inner rocker arms 50 and 52 are configured to operate between latched and unlatched positions relative to the outer rocker arm 54. In this regard, the first rocker arm assembly 10 has two movable roller rocker arms 50 and 52 mounted side by side within a single rocker arm assembly.

The DFHLA 36 has two oil ports including a lower oil port 62 that provides lash compensation and is fed engine oil similar to a standard HLA. An upper port 64, also referred to as a switching pressure port, provides the conduit between controlled oil pressure from the OCV 46 and the first latch 56. When the first latch 56 is engaged (latched), the first inner rocker arm 50 and the outer rocker arm 54 operate together. When the first latch 56 is not engaged (unlatched), the first inner rocker arm 50 and the outer rocker arm 54 can move independently.

The DFHLA 38 has two oil ports including a lower oil port 72 that provides lash compensation and is fed engine oil similar to a standard HLA. An upper port 74, also referred to as a switching pressure port, provides the conduit between controlled oil pressure from the OCV 48 and the second latch 58. When the second latch 58 is engaged (latched), the second inner rocker arm 52 and the outer rocker arm 54 operate together. When the second latch 58 is not engaged (unlatched), the second inner rocker arm 52 and the outer rocker arm 54 can move independently. The first inner rocker arm 50 has a first roller 76. The second inner rocker arm 52 has a second roller 78.

Notably, the configuration of the rocker arm assembly 10 having two DFHLAs 36 and 38 provides a solid foundation that inhibits side to side (lateral) rocking of the rocker arm assembly 10 and balances loading of the rocker arm assembly regardless of what latch configuration (first or second latch 56, 58) is implemented.

With continued reference to FIG. 1 and additional reference to FIG. 2, a second rocker arm assembly 110 configured for use with a single lash adjuster and constructed in accordance to another example of the present disclosure will be described. The second rocker arm assembly 110 can be configured for use in a Type II arrangement having a cam shaft 114 with a cam profile 116 and located above an engine valve 120 (overhead cam). In the particular example shown, the cam profile 116 includes two valve actuating lobes 122 and 124. In a Type II valve train, the cam profile 116 of the cam shaft 114 drives the rocker arm assembly 110, and the first end of the rocker arm assembly 110 pivots over a hydraulic lash adjuster (HLA) while the second end actuates the valve 120.

In one configuration according to the present teachings, the rocker arm assembly 110 pivots over a single lash adjuster configuration 134 having a DFHLA 136. As will become appreciated, the second rocker arm assembly 110 is actuated with a combination of the DFHLA 136 and associated oil control valve (OCV) 146. Again, the DFHLA is exemplary and other HLA's may be substituted within the scope of the present disclosure.

The second rocker arm assembly 110 includes a first inner rocker arm 150, a second inner rocker arm 152 and an outer rocker arm 154. The first inner rocker arm 150 cooperates with a first latch 156. The second inner rocker arm 152 cooperates with a second latch 158 (again the latch configurations are best shown in the example illustrated in FIGS. 2 and 3). The first and second inner rocker arms 150 and 152 are configured to operate between latched and unlatched positions relative to the outer rocker arm 154. In this regard, the second rocker arm assembly 110 has two movable roller rocker arms 150 and 152 mounted side by side within a single rocker arm assembly.

The DFHLA 136 has three oil ports including a lower oil port 162, a first upper port 164 and a second upper port 166. The lower port 162 provides lash compensation and is fed engine oil similar to a standard HLA. The first upper port 164, also referred to as a switching pressure port, provides the conduit between controlled oil pressure from the OCV 146 and the first latch 156. When the first latch 156 is engaged (latched), the first inner rocker arm 150 and the outer rocker arm 154 operate together. When the first latch 156 is not engaged (unlatched), the first inner rocker arm 150 and the outer rocker arm 154 can move independently.

The second upper port 166, also referred to as a switching pressure port, provides the conduit between controlled oil pressure from the OCV 146 and the second latch 158. When the second latch 158 is engaged (latched), the second inner rocker arm 152 and the outer rocker arm 154 operate together. When the second latch 158 is not engaged (unlatched), the second inner rocker arm 152 and the outer rocker arm 154 can move independently. As described, the hydraulic control of the DFHLA 136 and OCV 146 can include two independent ports (164, 166) for each of the pair of latch pins 156, 158 and provided within the DFHLA 136. Alternatively, an additional structure or hydraulic control can be provided that actuates the latch pins based on differences in supply pressure.

With additional reference to FIGS. 2A and 2B, additional features will be described. Depending on which latch pin 156, 158 is locked and unlocked there are four lift options. If the first inner rocker arm 150 is latched but the second inner rocker arm 152 is unlocked a first lift profile is achieved. If the second inner rocker arm 152 is latched but the first inner rocker arm 150 is unlocked, a second lift profile is achieved. If both the first and second inner rocker arms 150 and 152 are unlatched, then there is no lift. If the cams 122 and 124 provide a corresponding profile there could be a possibility of a fourth option when both of the first and second inner rocker arms 150 and 152 are latched. The fourth option can provide longer duration lift profiles. Other configurations are contemplated. The first inner rocker arm 150 has a first roller 176 configured to engage the valve actuating lobe 122 (FIG. 1). The second inner rocker arm 152 has a second roller 178 configured to engage the valve actuating lobe 124 (FIG. 2). FIG. 2B shows a two cam profiles 122 and 124 that are offset to provide four options. The cams 122 and 124 have different duration and phasing.

Figure 3:
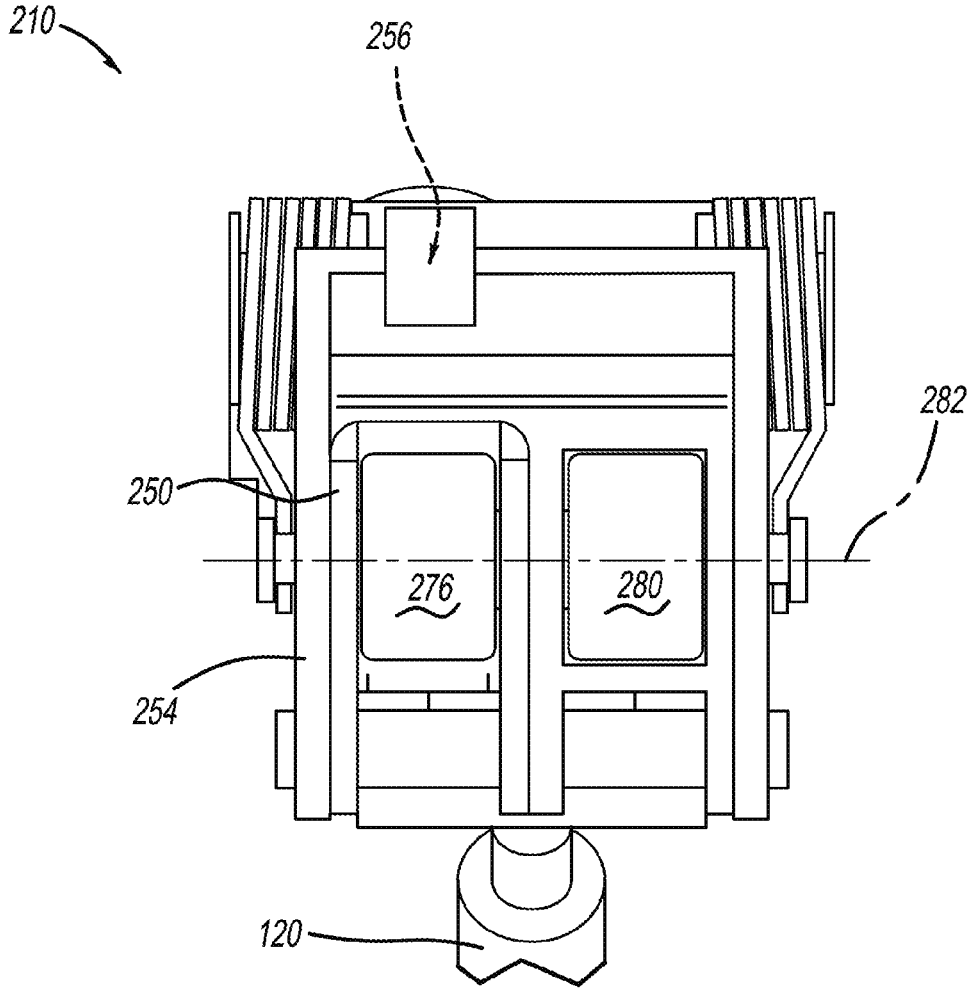
FIG. 3 is a top view of a third rocker arm assembly having a single movable roller rocker arm within the outer rocker arm assembly and having one latch pin.

Turning now to FIG. 3 a third rocker arm assembly 210 constructed in accordance to another example of the present disclosure will be described. The third rocker arm assembly 210 includes an inner rocker arm 250 and an outer rocker arm 254. The inner rocker arm 250 is located generally on one side of the third rocker arm assembly 210. In the third rocker arm assembly 210, there is only one latch pin 256 located within the outer rocker arm 254. The inner rocker arm 250 has a first roller 276. The outer rocker arm 254 has a second roller 280. The first and second rollers are arranged in a side-by-side relationship and configured to rotate around a common axis 282. In other examples, the first and second rollers may be arranged in a side-by-side relationship while rotating around distinct axes. When the inner rocker arm 250 is locked, a first lift profile is achieved. When the inner rocker arm 250 is unlocked, a second lift profile is achieved.

Figure 4:
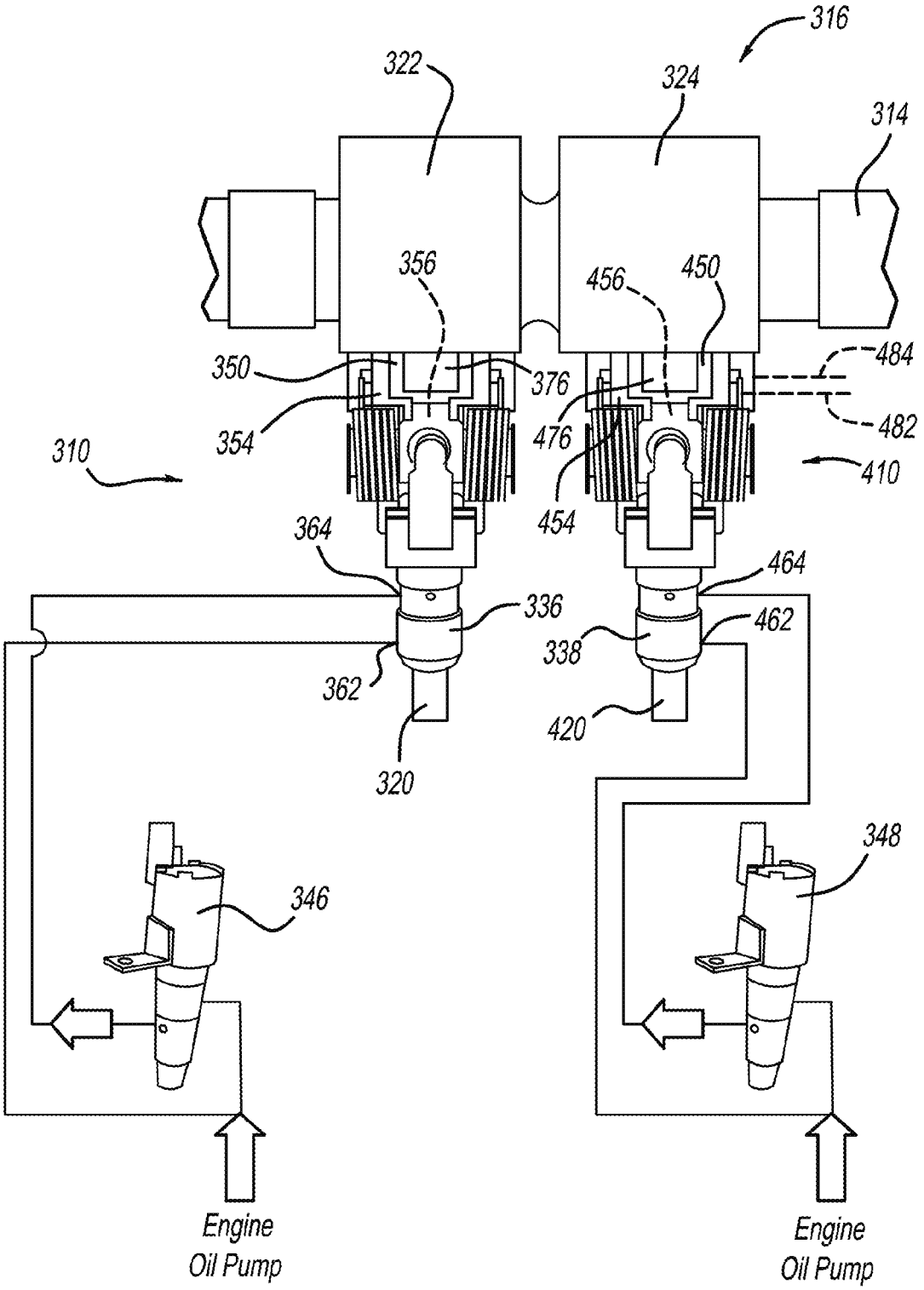
FIG. 4 is a rear view of a first and a second rocker arm assembly positioned in a cylinder head between a camshaft and a respective first and second lash adjuster according to other examples of the present disclosure.

Turning now to FIG. 4, a pair of first rocker arm assemblies 310, 410 configured for use with a respective lash adjuster and constructed in accordance to one example of the present disclosure will be described. The pair of first rocker arm assemblies 310, 410 can be configured for use in a Type II arrangement having a cam shaft 314 with a cam profile 316 and located above engine valves 320, 420 (overhead cam). In the particular example shown, the cam profile 16 includes two single-profile valve actuating lobes 322 and 324. In a Type II valve train, the cam profile 316 of the cam shaft 314 drives the rocker arm assemblies 310, 410 and the first end of each of the rocker arm assemblies 310, 410 pivots over a respective hydraulic lash adjuster (HLA) while the second end actuates the respective valve 320, 420.

In one configuration according to the present teachings, each of the rocker arm assemblies 310, 410 pivots over a dual-feed hydraulic lash adjuster (DFHLA) 336, 338. As will become appreciated, each of the first rocker arm assemblies 310, 410 is actuated with a DFHLA 336, 338 and an associated oil control valves (OCV) 346 and 348. It will further be appreciated that the DFHLA's are exemplary and other HLA's may be substituted within the scope of the present disclosure. It is also appreciated that other hydraulic configurations may be implemented for delivering hydraulic fluid to the DFHLAs 336 and 338. For example, only one DFHLA may be required for supplying hydraulic fluid concurrently to both of the DFHLA's. As will become appreciated herein, the present disclosure provides a reduced package two step actuating rocker arm with reduced complexity over prior art configuration.

Figure 6A:
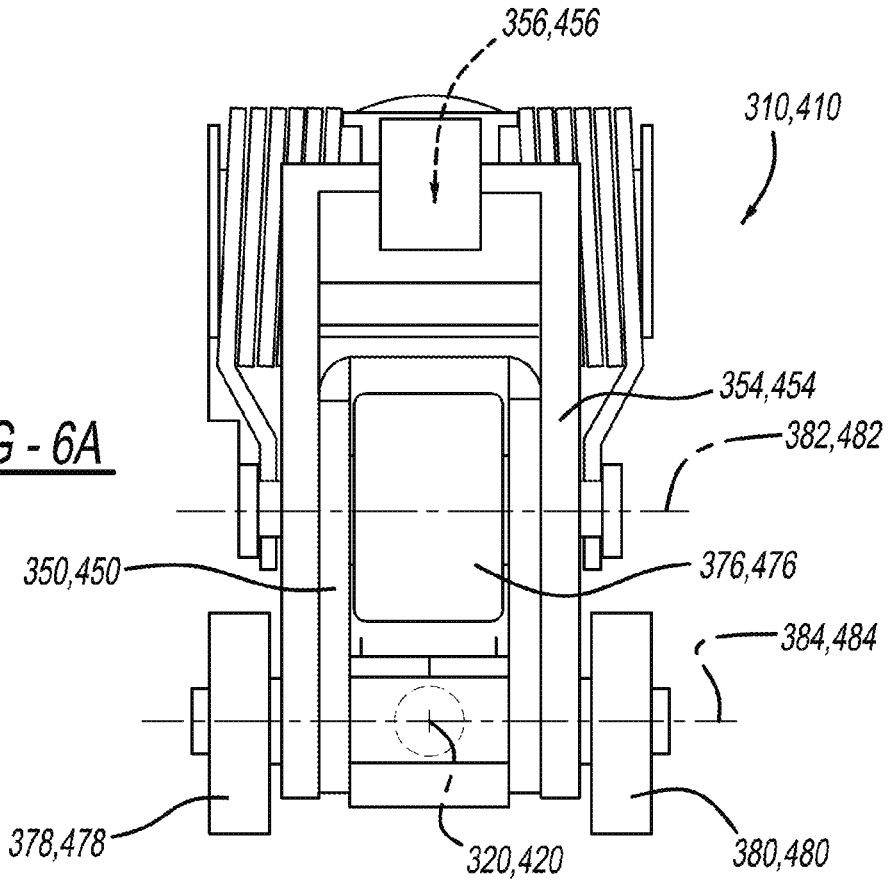
FIG. 6A is a top view of a rocker arm assembly having an asymmetrical roller where a second set of rollers are positioned over an engine valve.

The first rocker arm assembly 310 includes an inner rocker arm 350, and an outer rocker arm 354. The inner rocker arm 350 cooperates with a first latch 356 (FIG. 6A). As will be described herein, the inner rocker arm 350 is configured to operate between latched and unlatched positions relative to the outer rocker arm 354.

The DFHLA 336 has two oil ports including a lower oil port 362 that provides lash compensation and is fed engine oil similar to a standard HLA. An upper port 364, also referred to as a switching pressure port, provides the conduit between controlled oil pressure from the OCV 346 and the first latch 356. When the first latch 356 is engaged (latched), the inner rocker arm 350 and the outer rocker arm 354 operate together. When the first latch 356 is not engaged (unlatched), the inner rocker arm 350 and the outer rocker arm 354 can move independently.

With continued reference to FIG. 4 and additional reference to FIG. 6A, additional features of the first rocker arm assembly 310 will be described. The first rocker arm assembly 310 has an asymmetrical rocker arm roller design providing asymmetric loading. Other rocker arm assemblies having generally asymmetric geometries have been disclosed such as commonly owned U.S. Pat. No. 9,194,261 which is expressly incorporated herein by reference. The instant teachings however teach a rocker arm configuration having asymmetric loading. The inner rocker arm 350 has a first roller 376. The outer rocker arm 354 has a pair of second rollers 378, 380. In the examples shown in FIGS. 4, 6A and 6B, the pair of second rollers 378, 380 is positioned over the engine valve 320 but off center from the first roller 376.

Figure 6B:
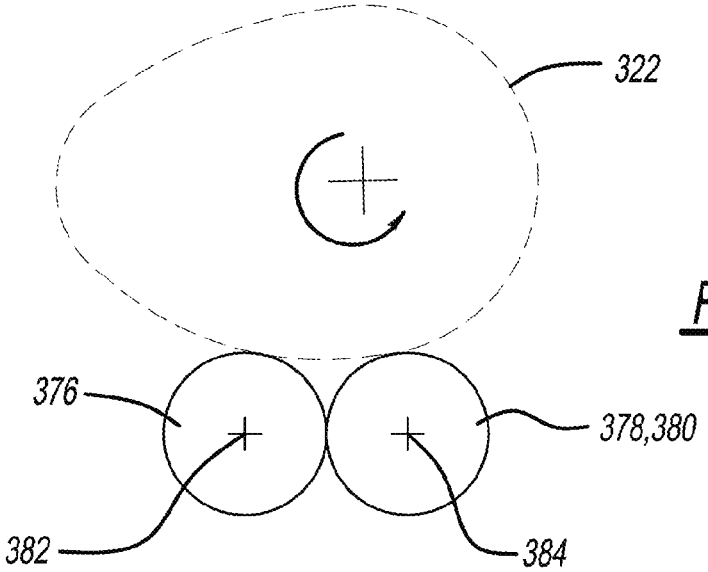
FIG. 6B is a side view of the offset rollers provided in the rocker arm assembly of FIG. 6A and shown with an associated cam.

With particular reference now to FIGS. 6A and 6B, the first roller 376 is configured to rotate about a first axis 382. The pair of second rollers 378, 380 is configured to rotate about a second axis 384. The first and second axes 382, 384 are offset. When the rocker arm assembly 310 is latched, the single cam profile 316 (lobe 322) will essentially rest between the two roller sets 376 and 378, 380. As the single cam profile 316 (lobe 322) rotates, it will open the engine valve 310 on one roller but close the engine valve 310 on the other roller. When the rocker arm assembly 310 is unlatched, the single cam profile 316 (lobe 322) will rest on one of the rollers and as the single cam profile rotates, it will open and close the engine valve 310 on the one roller(s). In another configuration, it is possible to only open and close the engine valve 310 on one roller (376 or 378, 380) when the rocker arm assembly 310 is latched and when the rocker arm assembly 310 is unlatched, it is possible to only open and close the engine valve 310 on the other roller (376 or 378, 380).

The first rocker arm assembly 410 is constructed similarly to the first rocker arm assembly 310. Like features are identified with like reference numerals increased by 100. In this regard, the first rocker arm assembly 410 has an asymmetrical rocker arm roller design providing asymmetric loading. The inner rocker arm 450 has a first roller 476. The outer rocker arm 454 has a pair of second rollers 478, 480.

In the examples shown in FIGS. 4 and 6A, the pair of second rollers 478, 480 is positioned over the engine valve 420, but off center from the first roller 476. The first roller 476 is configured to rotate about a first axis 482. The pair of second rollers 478, 480 is configured to rotate about a second axis 484. The first and second axes 482, 484 are offset. When the rocker arm assembly 410 is latched, the single cam profile 316 (lobe 324) will essentially rest between the two roller sets 476 and 478, 480. As the single cam profile 316 (lobe 324) rotates, it will open the engine valve 410 on one roller but close the engine valve 410 on the other roller. When the rocker arm assembly 410 is unlatched, the single cam profile 316 (lobe 324) will rest on one of the rollers and as the single cam profile rotates, it will open and close the engine valve 410 on the one roller(s). In another configuration, it is possible to only open and close the engine valve 410 on one roller (476 or 478, 480) when the rocker arm assembly 410 is latched and when the rocker arm assembly 410 is unlatched, it is possible to only open and close the engine valve 410 on the other roller (476 or 478, 480).

The DFHLA 338 has two oil ports including a lower oil port 462 that provides lash compensation and is fed engine oil similar to a standard HLA. An upper port 464, also referred to as a switching pressure port, provides the conduit between controlled oil pressure from the OCV 348 and the latch 456 of the rocker arm assembly 410. When the latch 456 is engaged (latched), the inner rocker arm 450 and the outer rocker arm 454 operate together. When the latch 456 is not engaged (unlatched), the inner rocker arm 450 and the outer rocker arm 454 can move independently. Again, Instead of having a dedicated OCV 348 for the DFHLA 338, the OCV 346 can be configured to deliver hydraulic fluid to both of the DFHLA's 336 and 338. Other configurations are contemplated.

Figure 5A:
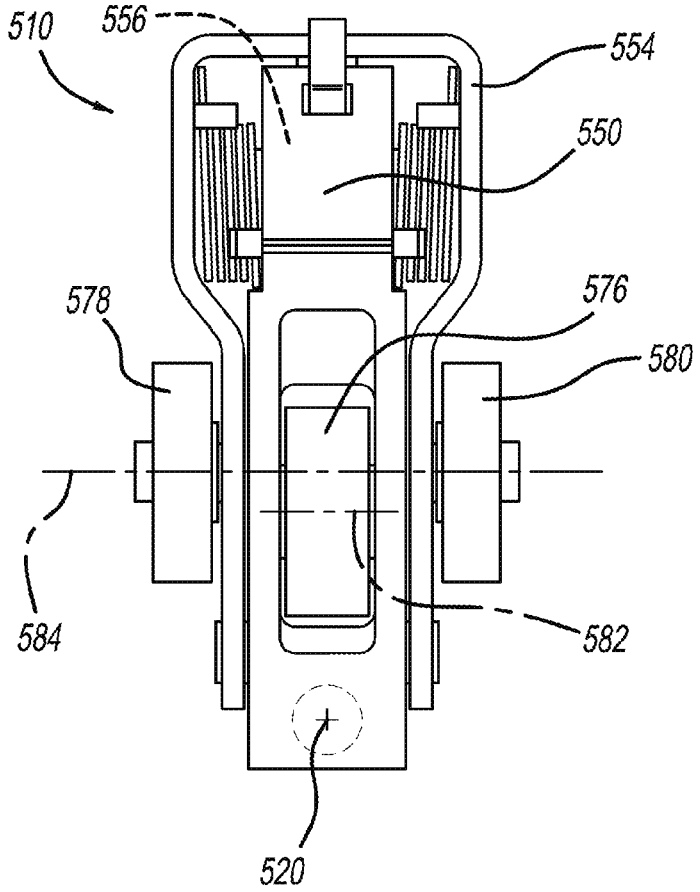
FIG. 5A is a top view of a rocker arm assembly having an asymmetrical roller where a second set of rollers are positioned in an offset location inboard of an engine valve.
Figure 5B:
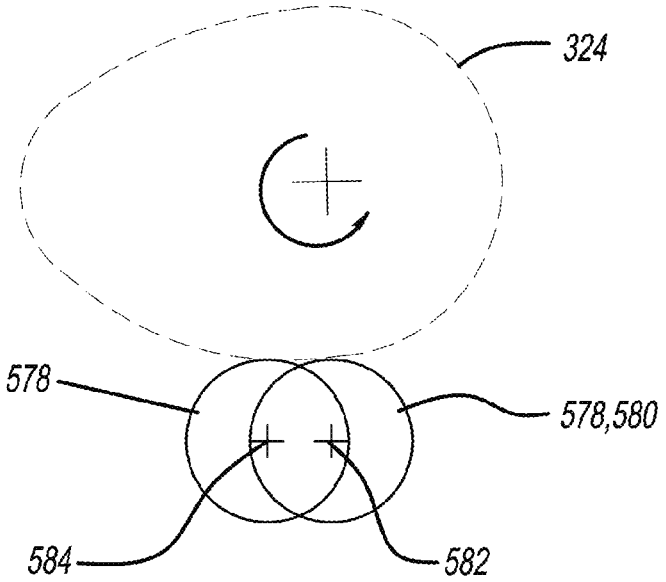
FIG. 5B is a side view of the offset rollers provided in the rocker arm assembly of FIG. 5A shown with an associated cam.

With reference to FIGS. 5A and 5B, a second rocker arm assembly 510 constructed in accordance to additional features will be described. The second rocker arm assembly 510 can be configured for use with the cam profile 316 but arranged where a valve 520 is located outside of the pair of rollers. Specifically, the second rocker arm assembly 510 has an asymmetrical rocker arm roller design providing asymmetric loading. An inner rocker arm 550 has a first roller 576. An outer rocker arm 554 has a pair of second rollers 578, 580. The inner rocker arm 550 cooperates with a latch 556. The inner rocker arm 550 is configured to operate between latched and unlatched positions relative to the outer rocker arm 554.

In the examples shown in FIGS. 5A and 5B, the pair of second rollers 578, 580 are positioned inside of the engine valve 520 but off center from the first roller 576. The first roller 576 is configured to rotate about a first axis 582. The pair of second rollers 578, 580 is configured to rotate about a second axis 584. The first and second axes 582, 584 are offset. While the pair of second rollers 578, 580 are shown inboard of the engine valve 520, the pair of second rollers 578, 580 may be located outboard of the engine valve 520 should cam design and valve opening/closing profiles dictate such positioning.

When the rocker arm assembly 510 is latched, the single cam profile (such as lobe 324 described above) will essentially rest between the two roller sets 576 and 578, 580. As the single cam profile rotates, it will open the engine valve 520 on one roller but close the engine valve 520 on the other roller. When the rocker arm assembly 510 is unlatched, the single cam profile will rest on one of the rollers and as the single cam profile rotates, it will open and close the engine valve 520 on the one roller(s). In another configuration, it is possible to only open and close the engine valve 520 on one roller (576 or 578, 580) when the rocker arm assembly 510 is latched and when the rocker arm assembly 510 is unlatched, it is possible to only open and close the engine valve 510 on the other roller (576 or 578, 580).

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A rocker arm assembly comprising:

an outer rocker arm;

a first inner rocker arm configured to move between a latched and unlatched position relative to the outer rocker arm;

a second inner rocker arm configured to move between a latched and unlatched position relative to the outer rocker arm, the second inner rocker arm positioned in a side-by-side relationship relative to the first inner rocker arm; and wherein the rocker arm assembly provides at least three distinct lift profiles including (i) a first lift profile when the first inner rocker arm is latched and the second inner rocker arm is unlatched, (ii) a second lift profile when the second inner rocker arm is latched and the first inner rocker arm is unlatched, and (iii) a third lift profile when both the first and second inner rocker arms are unlatched.

2. The rocker arm assembly of claim 1 wherein the rocker arm assembly further provides (iv) a fourth distinct lift profile when both the first and second inner rocker arms are latched.

3. The rocker arm assembly of claim 1, further comprising a dual lash adjuster configuration including a first hydraulic lash adjuster (HLA) and a second HLA.

4. The rocker arm assembly of claim 3 wherein the first HLA cooperates with a first oil control valve (OCV) to provide hydraulic fluid to the rocker arm assembly and actuate a first latch associated with the first inner rocker arm to move the first inner rocker arm between the latched and unlatched position.

5. The rocker arm assembly of claim 4 wherein the second HLA cooperates with a second oil control valve (OCV) to provide hydraulic fluid to the rocker arm assembly and actuate a second latch associated with the second inner rocker arm to move the second inner rocker arm between the latched and unlatched position.

6. The rocker arm assembly of claim 1, further comprising a single lash adjuster configuration including a hydraulic lash adjuster (HLA).

7. The rocker arm assembly of claim 6 wherein the HLA cooperates with an oil control valve (OCV) to provide hydraulic fluid to the rocker arm assembly and actuate (i) a first latch associated with the first inner rocker arm to move the first inner rocker arm between the latched and unlatched position and (ii) a second latch associated with the second inner rocker arm to move the second inner rocker arm between the latched and unlatched position.

8. The rocker arm assembly of claim 1 wherein the first inner rocker arm has a first roller and the second inner rocker arm has a second roller.

9. The rocker arm assembly of claim 8 wherein the first roller is configured to engage a first actuating lobe of a cam profile and the second roller is configured to engage a second actuating lobe of the cam profile.

10. A rocker arm assembly comprising:

an outer rocker arm having a first roller;

an inner rocker arm rotatably disposed within the outer rocker arm and offset toward a first side of the rocker arm assembly, the inner rocker arm configured to move between a latched and unlatched position relative to the outer rocker arm, the inner rocker arm having a second roller, wherein the first and second rollers are arranged in a side-by-side relationship, the first roller offset toward a second side of the rocker arm assembly, the second roller offset toward the first side of the rocker arm assembly; and a latch pin that selectively locks the inner rocker arm for concurrent rotation with the outer rocker arm.

11. The rocker arm assembly of claim 10 wherein the first roller and the second roller are configured for rotation around a common axis.

12. The rocker arm assembly of claim 10, further comprising a single lash adjuster configuration including a hydraulic lash adjuster (HLA).

13. The rocker arm assembly of claim 12, wherein the latch pin is offset laterally with the inner rocker arm toward the first side of the rocker arm assembly, wherein the HLA cooperates with an oil control valve (OCV) to provide hydraulic fluid to the rocker arm assembly and actuate the first latch pin to move the inner rocker arm between the latched and unlatched position.

14. The rocker arm assembly of claim 11 wherein the rocker arm assembly provides at least two lift profiles including (i) a first lift profile when the inner rocker arm is latched, and (ii) a second lift profile when the inner rocker arm is unlatched.

15. A rocker arm assembly comprising:

an outer rocker arm having a first roller configuration that rotates around a first axis;

an inner rocker arm having a second roller configuration that rotates around a second axis, the inner rocker arm configured to move between a latched and unlatched position relative to the outer rocker arm; and wherein the inner and outer rocker arms are asymmetric such that the first and second axes are offset, one of the first and second axes being positioned for alignment over an engine valve.

16. The rocker arm assembly of claim 15, further comprising a lash adjuster (HLA), wherein the HLA cooperates with a first oil control valve (OCV) to provide hydraulic fluid to the rocker arm assembly and actuate a first latch associated with the inner rocker arm to move the inner rocker arm between the latched and unlatched position.

17. The rocker arm assembly of claim 16 wherein the first roller configuration of the outer rocker arm comprises a pair of rollers.

18. The rocker arm assembly of claim 15 wherein when the inner rocker arm is latched, a single cam profile rests between the first and second roller configurations.

19. The rocker arm assembly of claim 18 wherein when the single cam profile rotates, the engine valve is opened on one of the first and second roller configurations and closed on the other of the first and second roller configurations.

20. The rocker arm assembly of claim 19, when the inner rocker arm is unlatched, the single cam profile rests on one of the first and second roller configurations.

21. The rocker arm assembly of claim 20, wherein when the single cam profile rotates, the engine valve is opened and closed on the second roller configuration.

22. The rocker arm assembly of claim 15 wherein the inner and outer rocker arms provide asymmetric loading.

23. The rocker arm assembly of claim 15 wherein the second axis is aligned with the engine valve.

* * * * *